United States Patent [19]

Brewer

[11] Patent Number: 4,475,310

[45] Date of Patent: Oct. 9, 1984

[54] BUMP GATE

[76] Inventor: Daniel J. Brewer, 4211 Austin Ave., Brownwood, Tex. 76801

[21] Appl. No.: 415,401

[22] Filed: Sep. 7, 1982

[51] Int. Cl.[3] ..... E06B 11/00

[52] U.S. Cl. ..... 49/131; 49/387

[58] Field of Search ..... 49/131, 33, 34, 364, 49/387; 16/81

[56] References Cited

U.S. PATENT DOCUMENTS 3,303,613 2/1967 Geuntjens ..... 49/131

FOREIGN PATENT DOCUMENTS 239682 5/1960 Australia ..... 49/131

1178739 9/1964 Fed. Rep. of Germany ..... 16/81

*Primary Examiner*—Kenneth Downey

*Attorney, Agent, or Firm*—Wm. T. Wofford; James C. Fails; Arthur F. Zobal

[57] ABSTRACT

A gate member has its lower end pivotally coupled to the lower ends of two spaced apart posts for pivotal movement about a horizontal axis whereby the gate member may be moved between an upright closed position and a lower open position. Closing means is provided for normally maintaining the gate means in its upright closed position.

9 Claims, 2 Drawing Figures

BUMP GATE

SUMMARY OF THE INVENTION

It is an object of the present invention to provide a gate for livestock or the like having a gate member which can be moved downward to an open position by a motor vehicle such that the motor vehicle can pass over the gate member and which automatically moves upward to a closed position after the motor vehicle moves away from the gate member.

The gate comprises two posts secured in the earth at spaced apart positions and a movable means having a lower end pivotally coupled to the lower ends of the two posts for pivotable movement about a generally horizontal axis whereby the movable means may be moved between an upright closed position and a lower open position. In addition, closing means is provided for normally maintaining the movable means in an upright closed position.

In a further aspect, the closing means comprises a flexible means having a first end connected to the upper end of said movable means and a second end connected to a weight means. In addition, a rotatable means is coupled to the upper end of one of said posts for supporting said flexible means for movement such that said weight means hangs downward from said rotatable means whereby when force is applied to said movable means transversely to and above said axis, said upper end of said movable means moves downward causing said weight means to be pulled upward and when the force is released from said movable means, said weight means applies, by way of said flexible means, an upward force to the upper end of said movable means.

In a further aspect, said one post comprises a hollow member with said weight means located in said hollow member for upward and downward movement therein. A liquid is located in said hollow member to slow the movement of said weight means in said hollow member.

DESCRIPTION OF THE PREFERRED EMBODIMENT

Figure 1:
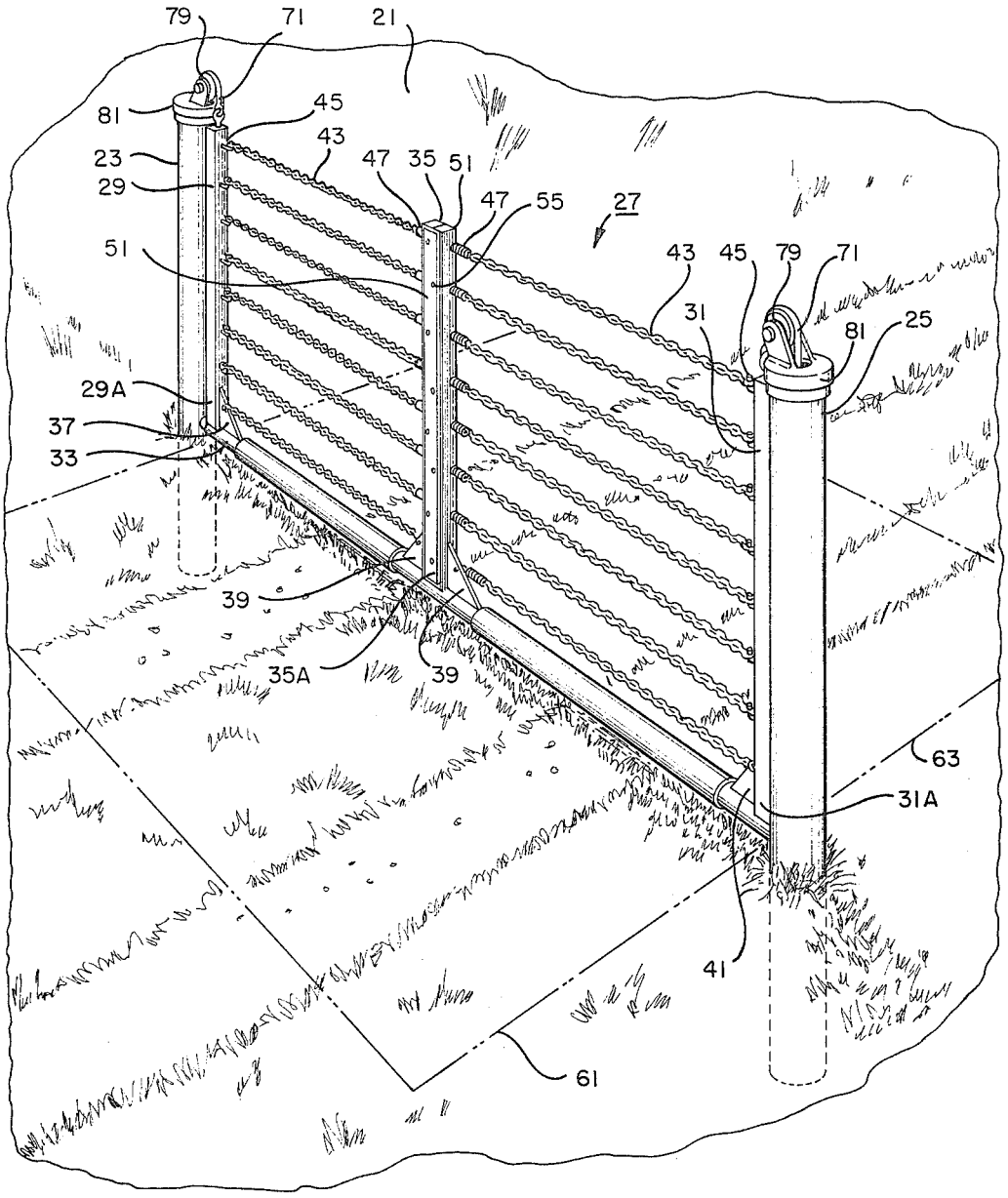
FIG. 1 illustrates the gate of the present invention.
Figure 2:
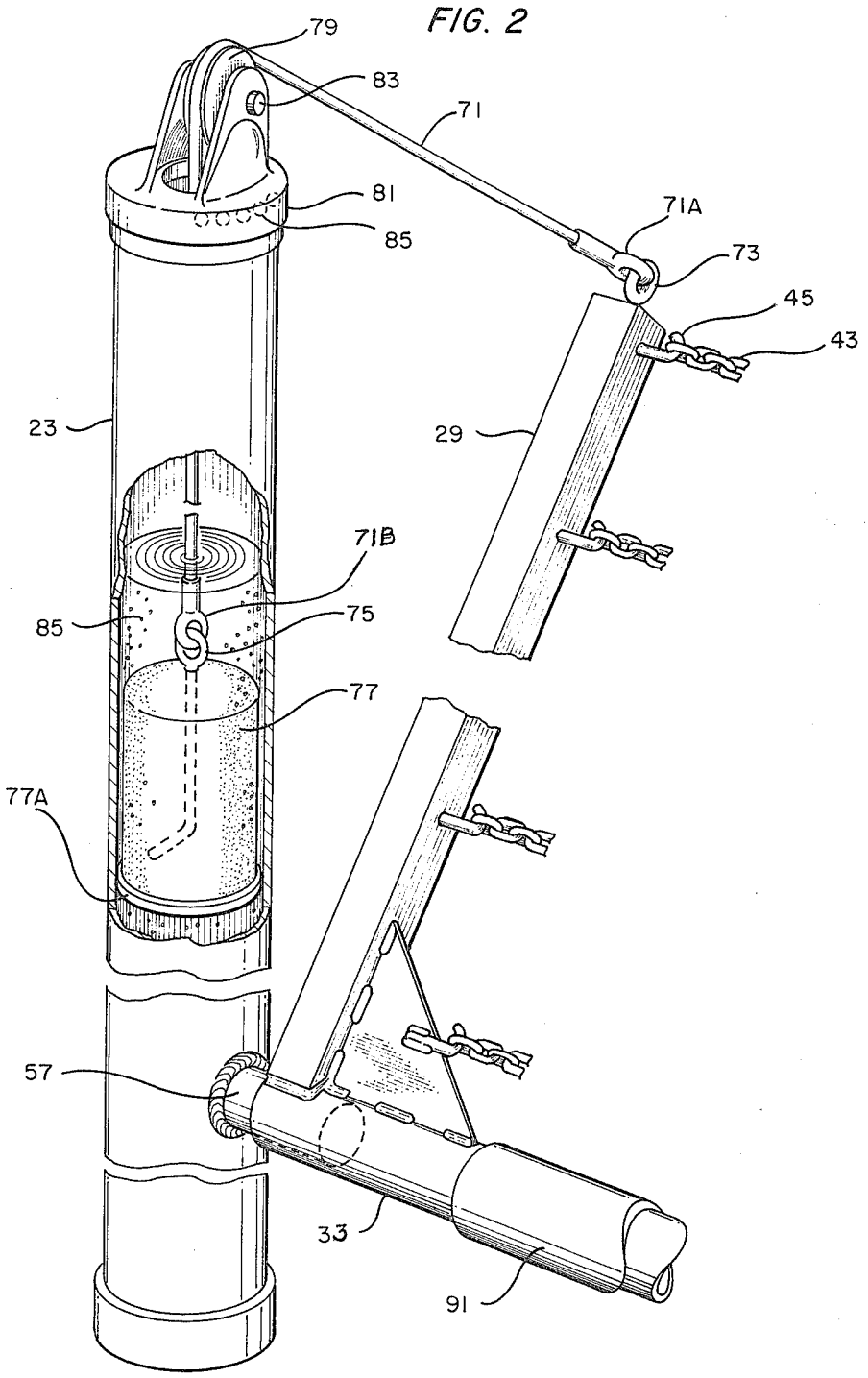
FIG. 2 is an enlarged portion of the gate of FIG. 1.

Referring to the drawings, the gate of the present invention is identified by reference number 21. It comprises two spaced apart posts 23 and 25 secured in the earth in upright positions and a gate member 27 coupled to the posts 23 and 25 and adapted to be moved to an upright closed position and to downward open positions. The two posts 23 and 25 are hollow cylindrical metal pipes. The gate member 27 comprises two spaced apart structural members 29 and 31 having their lower ends 29A and 31A welded to a hollow cylindrical metal pipe 33. A middle metal member 35 has its lower end 35A welded to the pipe 33. Members 29, 31, 33, and 35 define the plane of the gate member 27. Braces 37, 39 and 41 are welded to the lower end 29A of the member 29 and to pipe 33; to the lower end 35A of member 35 and to pipe 33; and to the lower end 31A of member 31 and to pipe 33 respectively. Chains 43 are connected between members 29 and 35 and between members 31 and 35 by way of hooks 45 secured to members 29 and 31 and springs 47 secured to opposite ends of member 35. Rubber or elastomer pads 51 are secured to opposite sides of member 35 by bolts 55 such that the heads of the bolts do not project outward beyond the outer surfaces of the pads 51.

Cylindrical shaped studs 57 are welded to the lower ends of posts 23 and 25 near the surface of the ground such that they are in alignment and extend toward each other. Opposite ends of the pipe 33 are fitted around the studs 57 respectively such that the pipe 33 and hence the gate member 27 may rotate or pivot around the studs 57 and hence around a horizontal axis, from an upright closed position as shown in FIG. 1 to either of two lower open positions as shown at dashed lines 61 and 63.

Closing means is coupled to each post and to opposite upper ends of the gate member 27 for normally maintaining the gate member in an upright position. The two closing means are identical. Thus, only the closing means associated with post 23 will be described. It comprises a rope or flexible cable 71 having one end 71A connected by way of a hook 73 to the upper end of member 29 and an opposite end 71B connected by way of a hook 75 to a weight 77 located in the post 23 for upward and downward movement. The cable 71 extends around a pulley 79 which is coupled to the top 23A of the post 23 by way of a swivel 81. The pulley 79 can rotate about a horizonal axis 83 and the swivel 81 can rotate aout a vertical axis defined by the axis of the post 23. The swivel 81 rotates on ball bearings illustrated at 85. The weight 77 attached to the cable 71 hangs downward from the pulley 79 in the interior of the post 23 whereby the weights 77 in both posts 23 and 25 normally maintain the gate member 27 in an upright position. When a force is applied to the gate member 27 from either side transversely to and above the axis defined by the pipe 33, the gate member 27 is forced downward to open positions 61 or 63. As the gate member 27 is forced downward, the weights 77 are pulled upward in the posts 23 and 25. When the force is released, the weights 77 fall downward in the posts 23 and 25 by the force of gravity and pull the gate member 27 to an upright position. The swivels 81 allow the pulleys 79 to be positioned such that the gate member 27 may be forced downward to open positions in either direction relative to its upright position. The posts 23 and 25 are filled with oil 85 to slow the upward and downward movement of the weights 77 in the posts 23 and 25. In this respect, there is a narrow clearance between the weights 77 and the inside surfaces of the posts 23 and 25 such that when the weights 77 move in the posts 23 and 25, the oil squeezes through the clearances slowing movement of the weights 77 in the posts 23 and 25.

An automobile or truck may open the gate member 27 from either side by driving forward allowing the bumper to engage the rubber pad 51 of member 35 forcing the member 35 and hence the gate member 27 downward to positions 61 or 63. As the gate member 27 moves downward, it pivots about the axis defined by pipe 33 and studs 57. The vehicle then can drive over the gate member 27. When the vehicle moves away from the gate member out of engagement therewith, the weights 77 pull the gate member 27 to an upright position. Metal sleeves 91 are secured around the pipe 33 to protect the pipe 33 from the weight of the vehicle. Preferably the bottoms of the sleeves 91 will engage the ground. Since the tires will roll over chains 43, the gate member 27 will not be damaged by the weight of the vehicle. It has been found that the structure of the gate member 27 including the chains 43 and the weights 77 is sufficient to keep livestock such as cattle from moving the gate member 27 to an open position.

In one embodiment, the distance between the posts 23 is ten feet such that the length of gate member 27 is somewhat less than ten feet. The height of the posts 23 above the ground may be of the order of five feet. Members 29 and 31 each are two-by-two inch square metal tubes. The member 35 is formed of two, two-by-two inch square metal tubes welded together. Pipe 33 has an inside diameter of two and onehalf inches. The inside diameter of each of posts 23 and 25 is six inches. The weight 77 comprises a five inch outside diameter metal cylinder, fifteen inches long, filled with concrete. Member 77A is a onehalf inch thick rubber or elastomer plate in the form of a disc bolted to the bottom of the weight 77. The outside diameter of plate 77A is less than the inside diameter of post 23 but sufficient to provide a clearance between the plate 77A and the inside diameter of the post to allow the passage of oil through the clearance between the plate 77A and the inside surface of the post 23. The total length of the posts 23 and 25 maybe seven feet. The oil 85 may be commercially available oil used in automobile engines. The use of oil as a liquid has advantages since it will not evaporate to any significant extent.

I claim:

1. A gate, comprising:

two hollow posts secured in the earth at spaced apart positions, a movable gate means comprising two spaced apart side members connected transversely to a lower member such that said lower member defines the lower end of said gate means, means for pivotally coupling the lower end of said gate means on each side thereof to the lower ends of said two posts respectively for pivotal movement about a generally horizontal axis whereby said movable gate means may be moved between an upright closed position and a lower open position, two weight means located in said two hollow posts respectively whereby said two weight means may be moved upward and downward in said two hollow posts, two flexible means having first ends connected to said two weight means respectively and having second ends connected to said two side members respectively of said gate means such that said two weight means hang downward in said two hollow posts whereby when force is applied to said movable gate means transversely to and above said axis, the upper end of said movable gate means moves downward causing said two weight means to be pulled upward, and when the force is released from said movable gate means, said two weight means, by way of said two flexible means, move said movable gate means to said closed upright position, and flexible structural means connected to said two side members, said flexible structural means being located between said two side members and the mid portion of said movable gate means between said two side members.

2. The gate of claim 1, comprising:

a liquid located in said two hollow posts to slow the movement of said two weight means in said two hollow posts.

3. The gate of claim 1, wherein:

said flexible structural means are located between said two side members and extend from said lower member to the upper end of said movable gate means.

4. The gate of claim 1, wherein:

the level of said means which pivotally couples the lower end of said gate means to the lower ends of said two hollow posts is fixed relative to said two hollow posts.

5. The gate of claim 1, comprising:

an intermediate member having a first end connected to said lower member between said two side members and having an opposite end extending to the upper end of said movable gate means, said flexible structural means comprising a plurality of flexible chains connected between said two side members and said intermediate member, said chains being located between said lower member and the upper end of said movable gate means such that said movable gate means between said two side members and said intermediate member and from said lower member to the upper end of said movable gate means is formed only of said chains.

6. The gate of claim 1, comprising:

two rotatable means coupled to the upper ends of said two hollow posts respectively for supporting said two flexible means respectively for movement to allow said two weight means to hang downward from said two rotatable means respectively and to be moved upward and downward as said movable gate means is moved downward and upward, said two rotatable means being coupled to the upper ends of said two hollow posts respectively such that said two rotatable means may rotate about two generally horizontal axes respectively and may turn about two generally vertical axes respectively.

7. The gate of claim 1, wherein:

said means for pivotally coupling the lower end of said movable gate means on each side thereof to the lower ends of said two hollow posts respectively allow said gate means to be moved between said upright closed position and a lower open position on either side of said two hollow posts.

8. The gate of claim 1, comprising:

a liquid located in two hollow posts to slow the movement of said two weight means in said two hollow posts, an intermediate member having a first end connected to said lower member between said two side members and having an opposite end extending to the upper end of said movable gate means, said flexible structure means comprising a plurality of flexible chains connected between said two side members and said intermediate member, said chains being located between said lower member and the upper end of said movable gate means such that said movable gate means between said two side members and said intermediate member and from said lower member to the upper end of said movable gate means is formed only of said chains, two rotatable means coupled to the upper ends of said two hollow posts respectively for suporting said two flexible means respectively for movement to allow said two weight means to hang downward from said two rotatable means respectively and to be moved upward and downward as said movable gate means is moved downward and upward, said two rotatable means being coupled to the upper ends of said two hollow posts respectively such that said two rotatable means may rotate about two generally horizontal axes respectively and may turn about two generally vertical axes respectively, said means for pivotally coupling the lower end of said movable gate means on each side thereof to the lower ends of said two hollow posts respectively allow said gate means to be moved between said upright closed position and a lower open position on either side of said two hollow posts, the level of said means which pivotally couples the lower end of said gate means to the lower ends of said two hollow posts is fixed relative to said two hollow posts.

9. The gate of claim 8, wherein:

said two flexible means have their second ends connected to the upper ends of said two side members respectively.

* * * * *